US005370467A

United States Patent [19]

Ikehata et al.

[11] Patent Number: 5,370,467

[45] Date of Patent: Dec. 6, 1994

[54] PRINT HEAD FOR DOT MATRIX PRINTER

[75] Inventors: Tsutomu Ikehata; Makoto Yasunaga; Yukihisa Kato, all of Tanashi, Japan

[73] Assignee: Citizen Watch Co., Ltd., Tokyo, Japan

[21] Appl. No.: 156,924

[22] Filed: Nov. 24, 1993

Related U.S. Application Data

[63] Continuation of Ser. No. 828,601, Jan. 31, 1992, abandoned.

[30] Foreign Application Priority Data

Jan. 31, 1991 [JP] Japan ..... 3-008399[U]

[51] Int. Cl.[5] ..... B41J 2/27

[52] U.S. Cl. ..... 400/124.21; 101/93.05

[58] Field of Search ..... 400/124; 101/93.05

[56] References Cited

U.S. PATENT DOCUMENTS

| | | | |
|---|---|---|---|
| 4,537,520 | 8/1985 | Ochiai et al. | 400/124 |
| 4,569,605 | 2/1986 | Meier et al. | 400/124 |
| 4,641,981 | 2/1987 | Blomquist et al. | 400/124 |
| 4,653,943 | 3/1987 | Sakaida et al. | 400/124 |
| 5,000,593 | 3/1991 | Gugel | 400/124 |
| 5,257,868 | 11/1993 | Ikehata et al. | 400/124 |
| 5,269,610 | 12/1993 | Tanida | 400/124 |
| 5,281,037 | 1/1994 | Asada et al. | 400/124 |
| 5,290,112 | 3/1994 | Stempfle et al. | 400/124 |

FOREIGN PATENT DOCUMENTS

| | | | |
|---|---|---|---|
| 95480 | 6/1982 | Japan | 400/124 |
| 56462 | 3/1988 | Japan | 400/124 |
| 63-78757 | 4/1988 | Japan | 400/124 |
| 63-106638 | 7/1988 | Japan | 400/124 |
| 197658 | 8/1988 | Japan | 400/124 |

*Primary Examiner*—David A. Wiecking

[57] ABSTRACT

A print head for a dot matrix printer has a yoke having a plurality of cores, a plurality of armatures, each corresponding to the core, a plurality of knife edges is formed on the yoke, and a receiving corner is formed on the armature which engages the knife edge so as to be pivoted about the knife edge.

3 Claims, 4 Drawing Sheets

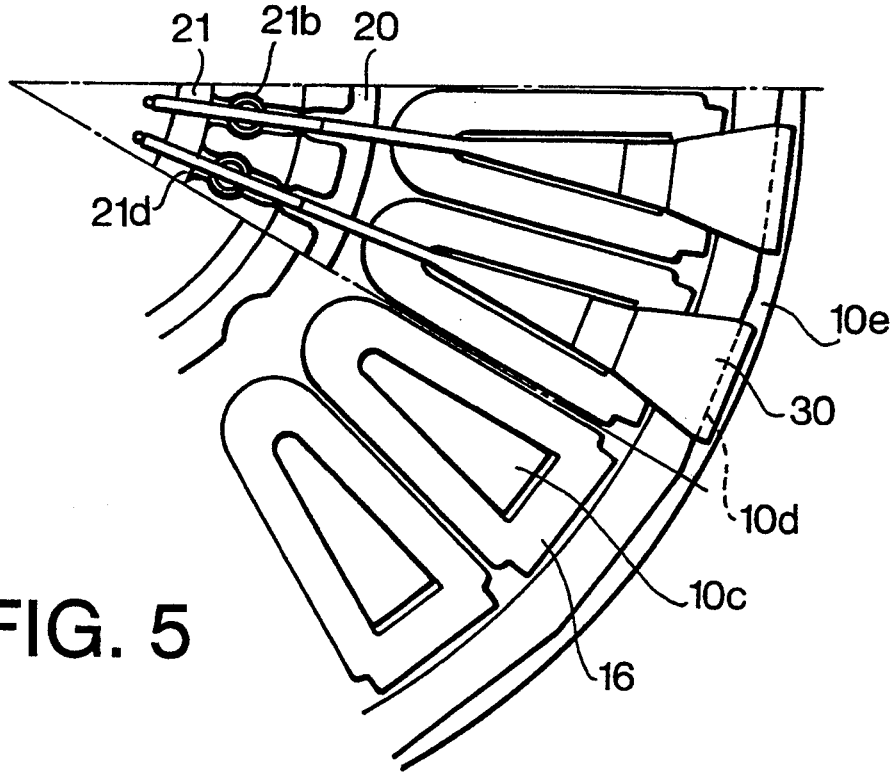
FIG. 5
FIG. 6
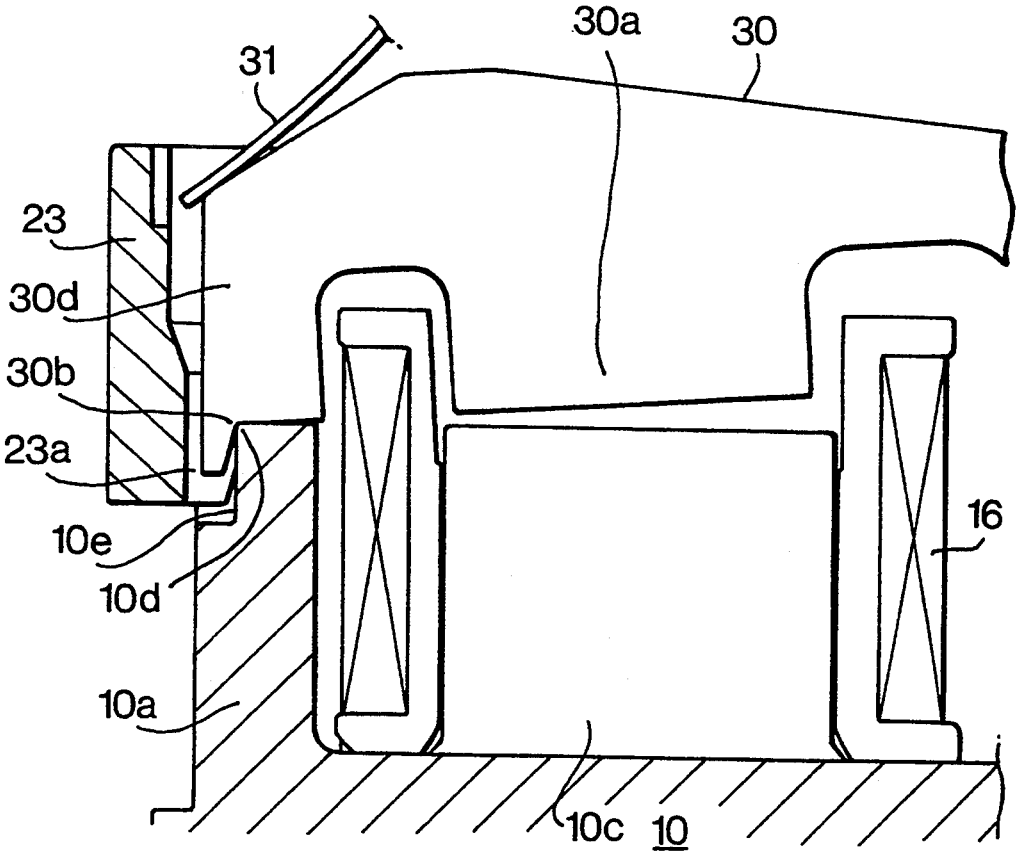

PRINT HEAD FOR DOT MATRIX PRINTER

This application is a continuation of application Ser. No. 07/828,601 filed on Jan. 31, 1992, now abandoned.

BACKGROUND OF THE INVENTION

1. Field of the Invention

The present invention relates to a print head for a dot matrix printer of an armature attracting type, and more particularly to a supporting structure of the armature.

2. Discussion of Related Art

Japanese Patent Application Laid-open 63-78757 (hereinafter called first reference) and Japanese Utility Model Application Laid-open 63-106638 (hereinafter called second reference) disclose print heads each having a supporting structure of an armature to be pivotable.

The print head of the first reference comprises a sub-yoke provided on a rear portion of a main yoke and having a post formed thereon, and an armature having a hole engaged with the post.

In the print head of the second reference, a yoke has a recess for positioning an armature. The armature has a projection engaged with the recess.

In the first reference, it is necessary to engage the armature with the hole with a gap. Consequently, the armature is not accurately positioned because of the gap. Furthermore, a number of the manufacturing processes and the parts are required for forming the posts on the sub-yoke.

In the second reference, it is difficult to perform a finishing machining of a top face of a core mounted on the yoke and the bottom of the recess at the same level with accuracy. Since the contact area of the projection of the armature with the recess of the yoke is small while a gap between the projection and the inside periphery of the recess is large, the magnetic resistance there-between is large. Namely, the magnetic efficiency is low in the magnetic circuit.

SUMMARY OF THE INVENTION

An object of the present invention is to provide a print head which may minimize the number of the parts of the print head and improve the accuracy in positioning the armature and the magnetic efficiency.

According to the present invention, there is provided a print head for a dot matrix printer having a yoke having a plurality of cores annularly provided on a base thereof, a plurality of armatures mounted on the yoke corresponding to the cores, and an armature spring engaged with each of the armatures for urging the armature to the yoke, characterized by a plurality of knife edges formed on the yoke, each functioning as a fulcrum for a respective armature, a receiving corner formed on the armature, corresponding to the knife edge, and an armature spring for urging the receiving corner to the knife edge.

In the present invention, the receiving corner of the armature is abutted! on the knife edge of the yoke. Thus, the armature can be pivoted about the knife edge in an accurately positioned state. Since the armature is supported with a simple construction without using further parts, manufacturing cost is reduced. Furthermore, a gap for the magnetic field between the armature and the yoke is reduced, thereby improving the magnetic efficiency.

These and other objects and features of the present invention will become more apparent from the following detailed description with reference to the accompanying drawings.

BRIEF DESCRIPTION OF DRAWINGS

FIG. 5 is a plan view partly showing an arrangement of armatures of the print head; and FIG. 6 is an enlarged sectional view showing an armature mounted on a yoke of the print head.

DETAILED DESCRIPTION OF THE INVENTION

Figure 1:
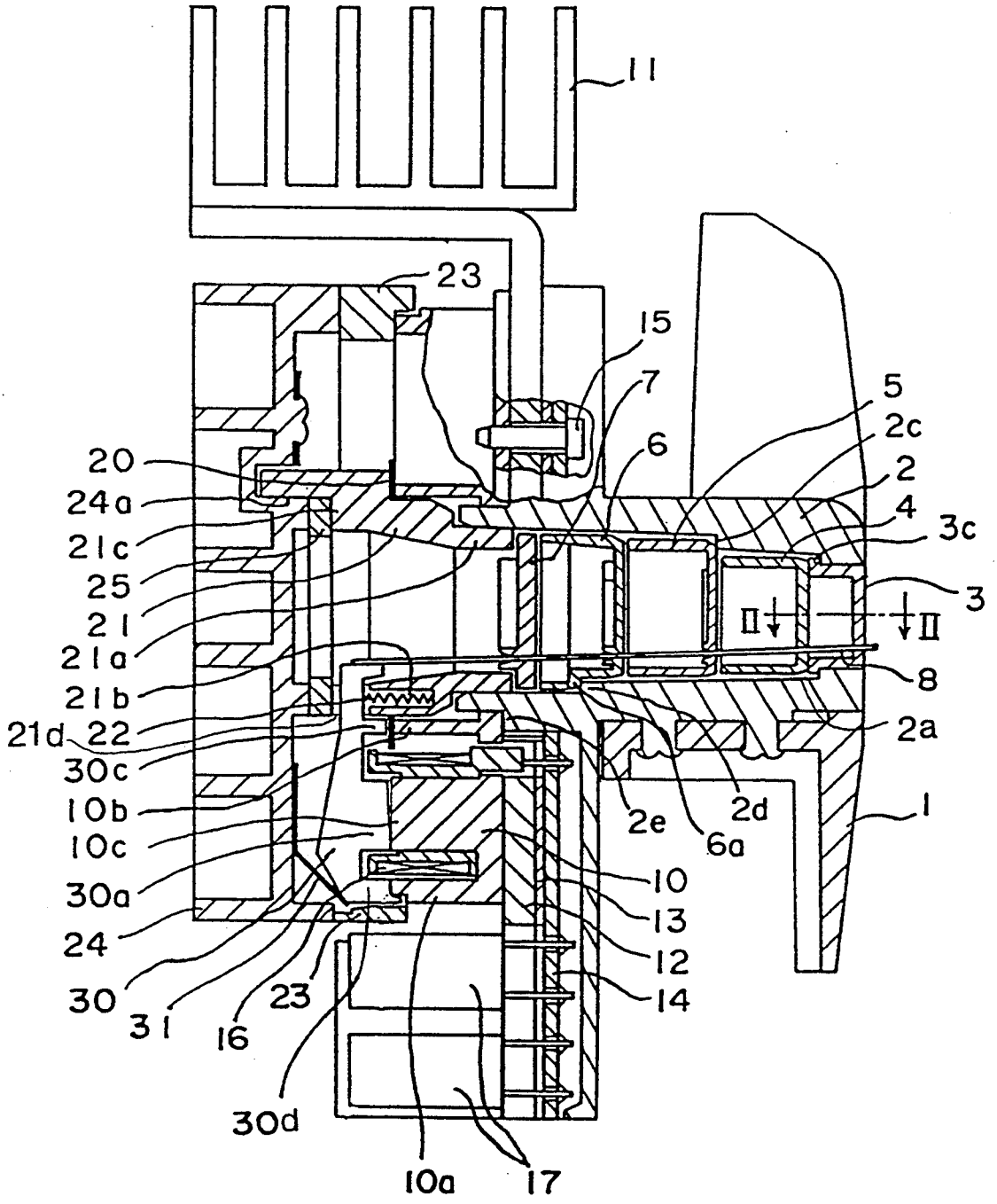
FIG. 1 is a sectional view showing a print head for a dot matrix printer according to the present invention.

Referring to FIG. 1, a print head comprises a print needle guide nose 2 having a hollow portion 2*a*. A ribbon guide 1 is secured to an end of the guide nose 2. In the hollow portion 2*a* of the guide nose 2, a front end guide member 3, three intermediate guide members 4, 5, and 6, and a rear end guide member 7 are provided. Each of the guide members has guide holes for print needles 8. A plurality of print needles 8 are slidably supported in the guide members 3 to 7.

The front end guide member 3 is independently positioned in the nose 2.

Figure 3:
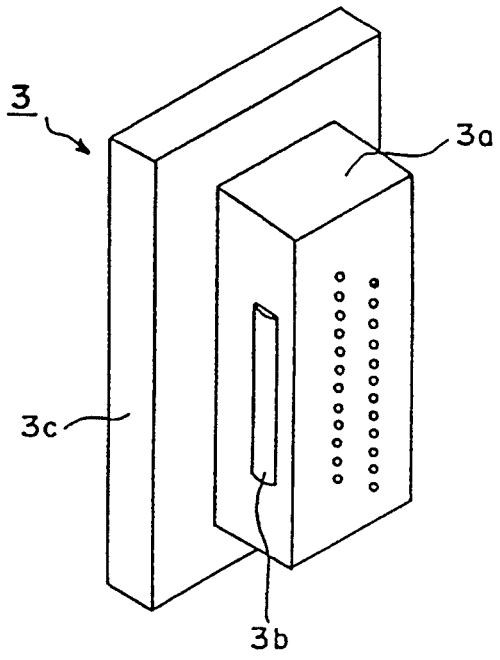
FIG. 3 is an enlarged perspective view showing a front end guide member of the print head.

Referring to FIG. 3, the front end guide member 3 comprises a rectangular member 3*a* having a plurality guide holes for the needles and an elongated projection 3*b* formed on each side portion thereof, and a flange portion 3*c* formed at a base of the member 3*a*. The projection 3*b* has an arcuate sectional shape.

Figure 4:
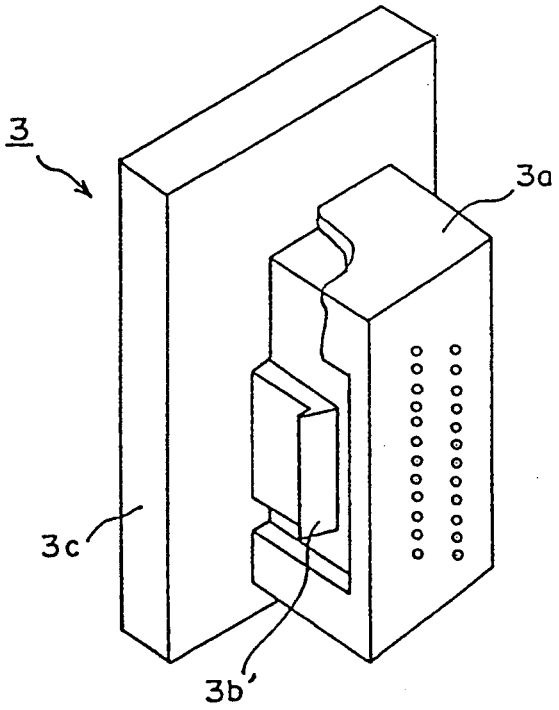
FIG. 4 is an enlarged perspective view showing a modification of the front end guide member.

FIG. 4 shows a modification of the front end guide member 3. An elongated projection 3*b'* in the form of a hook is formed on each side.

Figure 2:
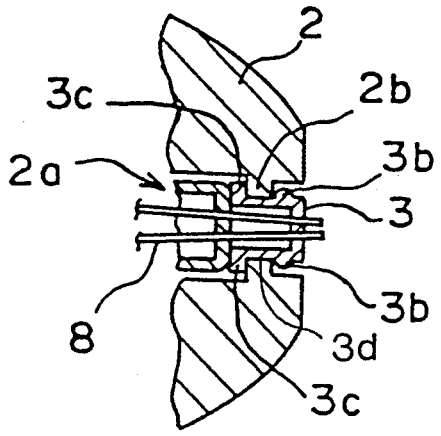
FIG. 2 is a sectional side view taken along a line II—II of FIG. 1.

In order to position the front end guide member 3 in the guide nose 2, the guide nose 2 has a pair of projections 2*b* provided on the inner walls thereof opposite to each other so that each projection 3*b* and the flange 3*c* define a groove 3*d* as shown in FIG. 2.

The intermediate guide members 5 and 6 are independently positioned in the nose 2. In order to position the guide members 5 and 6 in the guide nose 2, the nose 2 has shoulders 2*c* and 2*d* formed on the inner walls thereof as shown in FIG. 1.

When the intermediate guide members 4, 5 and 6 are mounted in the guide nose 2 in order, the intermediate guide member 5 which is larger than the intermediate guide member 4 is engaged with the shoulder 2*c* at the front end thereof. The intermediate guide member 6 has a step portion 6*a* engaged with the shoulder 2*d*.

The positions of shoulders 2*c* and 2*d* in the axial direction of the nose 2 are determined so as to absorb a dimensional error of the guide members. Namely, when the intermediate guide member 5 is mounted in the nose 2 and engaged with the shoulder 2*c*, a small gap is formed between the rear end of the guide member 4 and the front end of the guide member 5. Similarly, when the intermediate guide member 6 is mounted in the nose 2 and the step portion 6*a* is engaged with the shoulder 2*d*, a small gap is formed between the rear end of the guide members 5 and the front end of the guide member 6.

The intermediate guide member 4 is directly engaged with the front end guide member 3, and the rear end guide member 7 is restricted by a stopper 21 as described hereinafter.

The guide nose 2 has a positioning shoulder 2*e* formed on the outer periphery at a rear portion thereof. A cylindrical and annular yoke 10 is mounted on the shoulder 2*e*. The yoke 10 has a circumferential annular wall portion 10*a* and a center ring 10*b*. On the front portion of the yoke 10, a base 12 of a heatsink 11, an insulator 13 and a circuit board 14 are overlaid and secured thereto with screws 15. The yoke 10 has an annular groove formed between the annular wall portion 10*a* and the center ring 10*b*. A plurality of cores 10*c* are circularly formed in the annular groove as shown in FIG. 6. The top faces of the annular wall portion 10*a* and center ring 10*b*, and the attracting surface of each core 10*c* are formed in the same plane. A coil 16 is attached to each core 10*c* so that an electromagnet is formed. Terminals of the coil 16 are soldered to the circuit board 14 to which the terminals of connectors 17 are soldered.

A cylindrical guide stopper 21 is mounted in the center ring 10*b*, interposing a spacer 20. The guide stopper 21 has a stopper portion 21*a* inserted into the guide nose 2 to be abutted on the rear end guide member 7. Thus, the movement of the guide member 7 in the rearward direction is restricted by the guide stopper 21.

A cylindrical guide member 23 is secured to the outer periphery of the annular wall portion 10*a*. The guide member 23 has a plurality of grooves 23*a* for guiding an armature 30.

A plurality of armatures 30 are radially arranged on the yoke 10 corresponding to the cores 10*c* as shown in FIG. 5. The armature 30 has a plunger 30*a* provided corresponding to the core 10*c*, a stopper portion 30*c* abutted on the spacer 20 on the center ring 14, and a base end 30*d*.

Referring to FIG. 6, the annular wall portion 10*a* of the yoke 10 has a knife edge 10*d* defined by a flat plane 10*e* formed on the outer periphery thereof. The base end 30*d* of the armature 30 has a receiving corner 30*b* engaged with the knife edge 10*d*.

An end portion of the armature 30 is slidably engaged with a guide groove 21*d* formed in the guide stopper 21 and an actuating end of the armature 30 is extended in the stopper 21. Each of the print needle 8 is secured to the actuating end of the armature 30. A return spring 22 is provided in a hole 21*b* formed in the guide groove 21*d*, and engaged with the end portion of the armature 30. Thus, the armature 30 is rearwardly urged by the spring 22 to a ring stopper 25 secured to an inner shoulder 21*c* formed on the stopper 21.

A rear cover 24 is mounted on the cylindrical guide member 23. The rear cover 24 has grooves 24*a*, each of which is engaged with a projection of the guide stopper 21.

An armature spring 31 is disposed between the rear cover 24 and the base end 30*d* of the armature 30 to urge the receiving corner 30*b* to the knife edge 10*d* of the annular wall portion 10*a*.

Assembling of the print head is described hereinafter.

The front portion of the guide nose 2 having the ribbon guide 1 is held in a downward position. The front end guide member 3 is inserted into the hollow portion 2*a* of the nose 2 and the arcuate projections 3*b* are engaged with the projections 2*b*. The guide member 3 is further inserted with force, so that the projections 3*b* are deflected and pass over the projections 2*b*. Thus, the projections 2*b* are engaged with the groove 3*d* between the projections 3*b* and the flange 3*c* so that the guide member 3 is positioned and secured to the nose 2.

The intermediate guide member 4 is inserted into the nose 2 and engaged with the the guide member 3. The intermediate guide member 5 is inserted into the nose 2 and mounted on the shoulder 2*c*. The intermediate guide member 6 is inserted into the nose 2 and mounted on the shoulder 2*d* at the step portion 6*a*. The rear end guide member 7 is inserted into the nose 2 and engaged with the guide member 6. Thus, the guide members 4 to 7 are positioned in the nose 2.

On the other hand, the base 12 of the heatsink 11, insulator 13 and circuit board 14 are mounted on the yoke 10 and integrally assembled with the screws 15. The coils 16 are engaged with the cores 10*c* of the yoke. Terminals of the connectors 17 and coils 16 are soldered to the circuit board 14. The assembled yoke 10 is mounted on the positioning shoulder 2*e* of the guide nose 2. The spacer 20 is mounted on the center ring 10*b*. The guide stopper 21 is mounted on the spacer 20 while the stopper portion 21*a* is inserted into the nose 2. The guide member 23 is secured to the wall portion 10*a* and the return spring 22 is inserted in the hole 21*b*.

The armature 30 having the needle 8 is mounted on the yoke 10, inserting the end portion thereof in the guide groove 21*d* of the guide stopper 21. The needles 8 are slidably inserted into the guide holes of the respective guide members. The base end 30*d* of the armature 30 is engaged with the guide groove 23*a* of the guide member 23, abutting the receiving corner 30*b* on the knife edge 10*d*. The ring stopper 25 is mounted on the inner shoulder 21*c* of the guide stopper 21. The armature spring 31 is attached to the base end 30*d* and the rear cover 24 is mounted on the guide member 23 while the grooves 24*a* engage with the guide stopper 21. Finally, the outer peripheries of the guide nose 2 and the rear cover 24 are clamped together by clamps (not shown).

In operation, when the coil 16 is not excited, the armature 30 is biased to the stopper 25 by the armature spring 31 and the return spring 22. When the coil 16 is excited and the plunger 30*a* is attracted to the core 10*c*, the armature 30 is pivoted about the knife edge 10*d* of the yoke 10 at the receiving corner 30*b* against springs 31 and 22. Thus, the print needle 8, secured to the actuating end of the armature 30, slides in the guide members of the guide nose 2 and the end of the print needle 8 is projected from the guide nose 2 to print a dot on the printing paper mounted on the platen through the inked ribbon. When the coil 16 is de-energized, the armature 30 bounds back to the rest position by the return spring 22, pivoting about the knife edge 10*d*.

In accordance with the present invention, the receiving corner of the armature is abutted on the knife edge of the yoke. Thus, the armature can be pivoted about the knife edge in an accurately positioned state. Since the armature is supported with a simple construction without using a further parts, manufacturing cost is reduced. Furthermore, a gap for the magnetic field between the armature and the yoke is reduced, thereby improving the magnetic efficiency.

While the invention has been described in conjunction with preferred specific embodiment thereof, it will be understood that this description is intended to illustrate and not limit the scope of the invention, which is defined by the following claims.

What is claimed is:

1. A print head for a dot matrix printer comprising a needle guide nose, a plurality of print needles slidably mounted in said needle guide nose, a yoke secured to said needle guide nose having a plurality of cores provided on said yoke, a plurality of armatures, each corresponding to a print needle and to a core, an edge formed between a top surface and a peripheral side of said yoke, functioning as a fulcrum for each of said armatures;

a receiving corner formed by an underside of each of the armatures, and a plane corresponding to said peripheral side of said yoke, which corner is pivotally mounted on a corresponding edge of said yoke; and a leaf spring for urging said receiving corner to said corresponding edge, thereby to produce a component urging the armature in an inward direction and a component urging the armature to an axial direction of the print head.

2. A print head according to claim 1, wherein said yoke has a plurality of flat planes formed on said peripheral side thereof, thereby forming a plurality of associated edges, and a receiving corner of each of said armatures engages a corresponding edge of said yoke.

3. A print head according to claim 1, wherein said plane of the armature is formed on an inside of a projection formed on said underside of the armature.

* * * * *